US006715332B2

(12) United States Patent
Klingen et al.

(10) Patent No.: US 6,715,332 B2
(45) Date of Patent: Apr. 6, 2004

(54) METHOD OF DRAWING METAL WORKPIECES AND DRAWING UNIT FOR A DRAWING MACHINE

(75) Inventors: Hermann-Josef Klingen, Moers (DE); Norbert Zillekens, Hückelhoven (DE); Karl-Heinz Häusler, Korschenbroich (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 10/143,727

(22) Filed: May 9, 2002

(65) Prior Publication Data

US 2002/0189315 A1 Dec. 19, 2002

(30) Foreign Application Priority Data

May 10, 2001 (DE) ..... 101 22 657

(51) Int. Cl.[7] ..... B21C 1/30

(52) U.S. Cl. ..... 72/291; 72/278; 72/287; 72/405.02; 72/430; 226/4; 226/112

(58) Field of Search ..... 72/214, 252, 274, 72/278, 287, 290, 291, 301, 302, 311, 378, 405.02, 430; 226/4, 108, 112, 158, 162

(56) References Cited

U.S. PATENT DOCUMENTS

| | | | | | |
|---|---|---|---|---|---|
| 2,787,369 | A | * | 4/1957 | Kriedler | 72/290 |
| 3,075,636 | A | * | 1/1963 | Manning et al. | 72/31.13 |
| 3,844,152 | A | * | 10/1974 | Peytavin | 72/290 |
| 3,881,339 | A | * | 5/1975 | Mannell | 72/257 |
| 4,879,892 | A | * | 11/1989 | Paraskevas | 72/290 |
| 5,771,727 | A | * | 6/1998 | Stinnertz et al. | 72/21.4 |

* cited by examiner

*Primary Examiner*—Ed Tolan
(74) *Attorney, Agent, or Firm*—Herbert Dubno

(57) ABSTRACT

A drawing apparatus for drawing metal and articles has at last one drawing carriage and a linear motor complex which determines the pattern of movement of that carriage and hence of the drawing operation.

13 Claims, 13 Drawing Sheets

METHOD OF DRAWING METAL WORKPIECES AND DRAWING UNIT FOR A DRAWING MACHINE

SPECIFICATION

1. Field of the Invention

Our present invention relates to a drawing unit for a drawing machine and to a method of drawing an elongated metallic workpiece and suitable for use in a drawing machine.

2. Background of the Invention

Metallic workpieces such as rods, bars and tubes can be drawn by applying a linear pull to the workpiece to draw through a die which reduces the cross section and thus provides a draft in the workpiece, and in part a shape or profile thereto.

Drawing machines of this type can include at least one drawing carriage with a drive for imparting a linear displacement to the carriage. The carriage can be displaced back and forth in a machine frame. The carriage may be provided with jaws capable of engaging and disengaging from the workpiece. The machine used for this purpose can operate continuously on the workpiece and thereby produce a workpiece at limited length or can be a discontinuously operating machine such as a drawing bench.

An example of a continuous linear drawing machine is the machine described in DE OS 28 52 071. This patent publication discloses a carriage-type drawing machine with a drawing unit having two drawing carriages displaceable in guides of a machine frame which run parallel to the drawing direction. The drawing carriages move counter to one another and, in their back and forth movement, draw the workpiece in an endless fashion by a hand-to-hand pulling of the workpiece through the die. The displacement of the carriages is effected by double-arm levers and a double-curved cam which displaces the same.

Another drive system which can be used is that of EP 0 371 165 A1 which has a rotating drum with a cam on its surface formed by a rib and producing opposite movements of two carriages in the back and forth sense.

The strokes of these carriages are relatively small and, as a consequence, the carriages are mostly either in an accelerating or braking mode. So that high mean drawing speeds can be achieved, therefore, they must operate at relatively high stroke frequencies. However, the frequencies at which they can operate is not unlimited since at the points at which reversal of travel direction occur, high inertial forces must be overcome.

OBJECTS OF THE INVENTION

It is, therefore, the principal object of the present invention to provide an improved drawing apparatus which can overcome the drawbacks of these earlier systems and permit optionally longer strokes of the carriages and higher mean carriage speeds than has been possible heretofore.

It is also an object of the invention to provide a drawing unit or apparatus which is free from drawbacks of prior art systems.

A further object is to provide a method of operating a drawing machine or an improved method of drawing elongated metallic workpieces whereby disadvantages of earlier techniques can be avoided.

SUMMARY OF THE INVENTION

These objects and others which will become apparent hereinafter are achieved, in accordance with the invention, in a drawing unit for a drawing machine capable of drawing an elongated metal workpiece and having at least one die through which the workpiece is drawn. According to the invention the drawing unit comprises:

- a machine frame forming an elongated path along which the workpiece is drawn;
- at least one drawing carriage provided with a workpiece gripper and displaceable back and forth linearly along the path to draw the workpiece through the die; and
- a controlled linear motor complex assigned to the drawing carriage and acting upon the respective drawing carriage for independent displacement of the drawing carriage along the path.

The method of the invention can comprise displacing at least one drawing carriage of a drawing apparatus and preferably a plurality of drawing carriages by respective linear motor complexes so that the pattern of movement of the respective drawing carriage can be flexibly adjusted as required by control of the respective linear motor. In a preferred mode of operations, for each pull of the workpiece through the die, at least one pair of such carriages simultaneously engage and displace the workpiece under the control of the linear motor complexes driving the carriages of the pair.

Advantageously the drives for the respective linear motors are individually controlled and regulated and thus the individual linear motor complexes are individually controlled for the respective drawing carriages to provide movement patterns of the drawing carriages which are independent of one another.

By comparison with the drive system of the prior art, the movement pattern of the individual carriages are substantially more flexible. The linear motors allow the stroke lengths, the displacements and the locations of the strokes and displacements of the individual carriages along the path to be selected in a variable manner which is no longer limited by a fixedly located cam.

The linear motors can be controlled with precision and provide a rapid acceleration and rapid braking. They can provide especially long strokes, even where they are used to create back and forth movement of the carriage and thus can provide average drawing speeds which are significantly greater than those attainable heretofore since the acceleration and braking segments can be proportionately shorter. In addition, the respective carriages can have different and controllable speeds for the forward and rearward strokes. As a consequence, the displacement of a carriage backwardly to engage the workpiece can be greater than has been possible heretofore and thus the time consumed in the rearward travel can be reduced and the productivity of the apparatus enhanced. In addition, since a complex mechanical drive below the carriages is not required, the overall height of the drawing machine can be significantly reduced.

Preferably the linear motor complex for a pulling carriage or slide encompasses one or more linear motor units assembled in a modular fashion by appropriate selection of the number and/or drive force of the linear motor units. Starting from a basic carriage which either has no linear motor unit or a unit of low power, the power applied to a carriage can be built up by assembling additional motor units therewith.

In a first embodiment of the invention the primary part or primary parts of the linear motor unit or units constitute movable members on a carriage and are assembled in a modular construction whereas the secondary part or parts are stationary elements which are disposed along the machine frame as metal tracks or rails for the carriage. The guide of the carriage along the path may utilize separate guide rails.

In a preferred second embodiment there is kinematic reversal and the primary part or parts of the linear motor unit or units are formed as stationary elements along the machine frame whereas the secondary part or parts are movable elements connected to the respective carriage and displaceable along the primary parts. The secondary parts of the linear motor units are thus applied to the carriages while the primary parts are mounted on the machine frame.

The predrawing of the end of the workpiece which is required to enable the workpiece to be gripped by the jaws of the drawing carriages can be effected with a separate predrawing carriage which can have either a linear motor drive or a hydraulic drive, or as a combined predrawing and drawing carriage. The latter is preferably provided with a linear electric motor drive although it can have a mechanical, e.g. hydraulic, drive.

Such a combined predrawing and drawing carriage, referred to herein as a "combi-carriage", can have two clamping jaw pairs with the first pair engageable with the stem of the workpiece which is fitted through the die to commence the drawing process while the second pair engages the outer periphery of the workpiece, e.g. a tube behind this stem.

One drawing unit has only one such carriage, namely a combination predrawing and drawing carriage, forms the first unit for a basic unit for a drawing apparatus or line. A tube, for example, can be drawn with such a unit discontinuously utilizing the single carriage which can be displaced over a certain short stroke back and forth to allow tubes of relatively long length to be drawn. The base unit serves especially for an apparatus having a relatively low capacity and can be made at limited capital cost.

This basic unit can be expanded by providing two or more further driving carriages in conjunction with the combined predrawing and drawing carriage. In this case, the combi-carriage serves to predraw the workpiece in a first step and thereafter serves purely for drawing the workpiece in conjunction with the additional drawing carriages, for example in a hand-to-hand or continuous operation.

Another basic unit for a drawing line can have a separate predrawing carriage and two or more drawing carriages. This arrangement has the advantage that the predrawing carriage need have only one pair of clamping jaws which are designed to engage the leading end of the tube. A predrawing carriage of this type is of latter construction than a combi-carriage and permits a higher rate of acceleration. This system is also advantageous since all of the carriages, namely, the predrawing and the regular drawing carriages, need have only one pair of jaws each which limits the capital cost of the system.

In both cases, either the predrawing operation can utilize a basic carriage of modular construction with its own linear motor complex also of modular construction which can be assembled with either fewer parts or parts of smaller power than may be required for the regular drawing carriages, which must have higher drawing forces.

The drawing units of the invention can, of course, have more than two drawing carriages and can be so constructed and arranged that two or more drawing carriage simultaneously engage the workpiece during the drawing or pulling operation.

According to a feature of the invention, each drawing carriage is itself driven by a linear motor complex and the pattern of movement of the respective drawing carriage is flexibly controlled by the control, usually via a computer, of the respective linear motor complex. This permits a flexibility and variability of the drawing path and the functions of the individual carriages which has not been attainable heretofore.

From the method point of view, the movement pattern during drawing of an apparatus with more than two drawing carriages is so controlled that two or more drawing carriages simultaneously engage the workpiece and are displaced by their linear motor complexes in the drawing direction. Preferably at least one pair of drawing carriages is engaged with the workpiece for the drawing action. In this system, the pairs of carriages which are effected to draw the workpiece may be reformed by pairing off the different carriages while the unpaired carriage is displaced in a return movement. The pairing of carriages for the drawing operation allows multiplication of the drawing force. The drawing force thus is a function of the number of carriages which simultaneously engage the workpiece during the drawing operation and thus is doubled for a pair of carriages, tripled for three carriages, etc.

With the drawing apparatus having a total of there drawing carriages, therefore, the following drawing pattern may be used: drawing of the workpiece by two carriages while the third carriage is displaced in a return direction, recombining the carriages so that another pair then serves for drawing while a third carriage is returned and repeating the re-pairing in each case so that all of the carriages are paired with each other carriage for the drawing operation while another carriage is displaced in the return direction.

By contrast with the earlier drive systems which always required two carriages to move simultaneously in opposite directions, the linear motor complexes of the invention enable pairing of the carriages for joint drawing of the workpieces.

The invention can operate in a continuous drawing operation where each drawing stage utilizes a different pair of jaw. For a discontinuous drawing machine, here a drawing bench, the drawing unit can include a drawing chain into which the drawing carriage is connected. At the end of the pull, the carriage is released from the chain and returned to its starting position with a linear electric motor. For low drawing forces, the drawing chain can be eliminated entirely and both the forward and rear movements can be effected by the linear motor complex.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
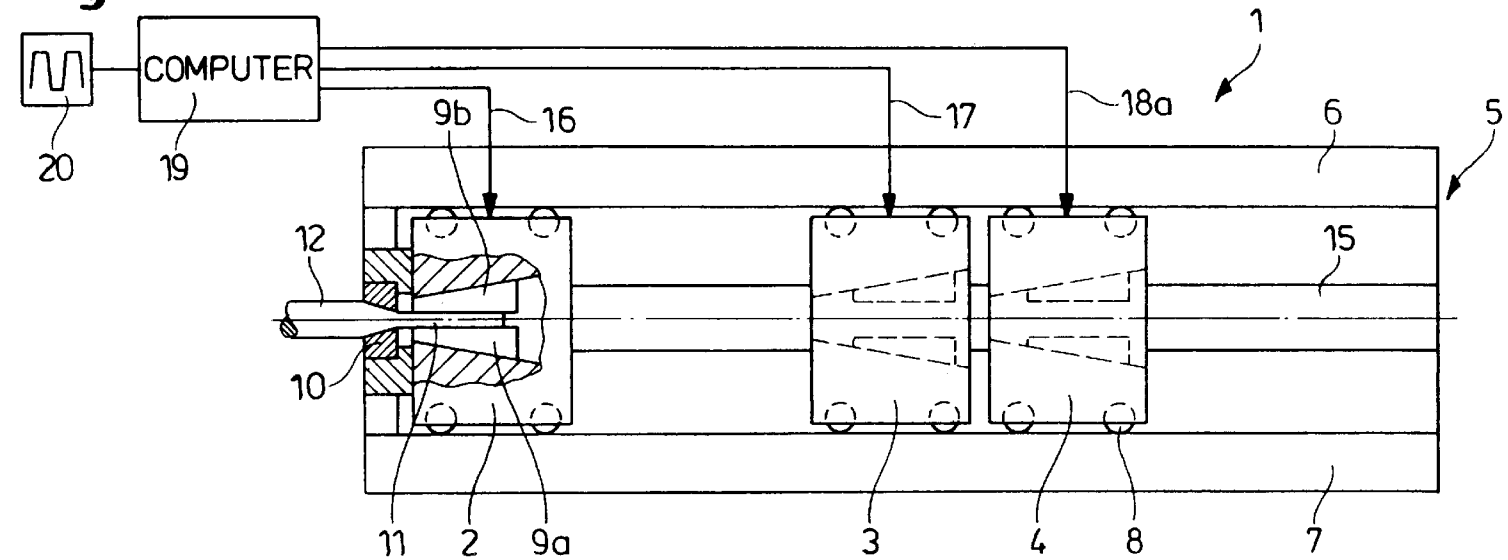
FIG. 1 is a diagram of a drawing unit of a drawing machine with a separate predrawing carriage and two drawing carriages at the beginning of a drawing process.

FIG. 1 shows a drawing unit 1 having a predrawing carriage 2 and two main drawing carriages 4, 5. The drawing unit 1 has a machine frame 5 with mutually parallel guide rails 6, 7. The carriages 2, 3 and 4 themselves are each provided with traveling rollers 8. Only one set of those rollers has been shown for each carriage. The rollers allow the carriages to travel along the guide rails 6 and 7 as if the latter formed a track. The predrawing carriage 2 as well as the main drawing carriages 3 and 4 each have a pair of clamping jaws 9*a*, 9*b*; 21*a*, 21*b*; 22*a*, 22*b*. The clamping jaws are wedge-shaped and pressed together when they receive the workpiece under tension and the carriages are shifted to the right. A shift of the carriage to the left will release a workpiece.

The drawing unit 1 is provided with a drawing die 10 which is mounted at the upstream end of the drawing path. The drawing die 10, here a so-called drawing ring, passes the stem 11 of the workpiece 12 which can be a bar, a tube or a wire, and which has been reduced prior to drawing so as to be able to pass through the die ring. The stem 11 can be formed at the leading end of a tube or rod by forging or machining. The predrawing carriage 2 has the function of engaging this stem, which has a reduced cross section by comparison with the tube portion which follows, so that the predrawing carriage 2 can use clamping jaws 9*a*, 9*b* with a smaller opening than the clamping jaws engageable with the outer periphery of the tube 25.

The predrawing carriage 2 and the two main drawing carriages 3, 4 are provided with linear electric motor complexes 13 (see FIG. 20) for displaying these carriages back and forth along the guide rolls, 6, 7. The illustrated drawing unit has the secondary parts 15 of the linear motor complexes 13 formed as path-defining rails and rigidly mounted between guide rails 6, 7 and likewise extending in the drawing direction.

In FIG. 1, moreover, we have shown a control for the individual carriages which can be used for the individual carriages in the other Figures as well. Each of the carriages 2, 3 and 4 is connected via respective signal conductors 16, 17, 18*a* with a computer 19. The computer 19 defines the pattern of movement of the respective carriage with respect to its feed position and the force generated thereby. The movement patterns of the carriages can be displayed on a monitor 20.

The kinematic reverse of the parts can also be provided whereby the primaries of the linear motor complexes can be on the frame 5 and the secondary on the carriages.

Figure 2:
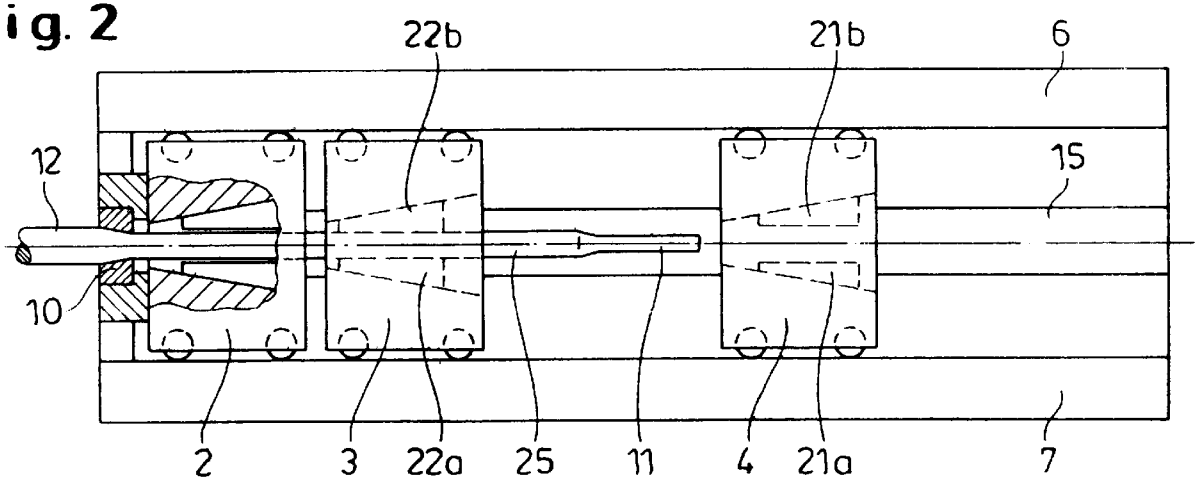
FIG. 2 is an illustration similar to that of FIG. 1 at the beginning of the drawing operation.

At the beginning of a drawing operation, the predrawing carriage 2 is in its left-hand position (FIG. 1) and engaged with the stem 11. The tube is drawn to the right and the predrawing carriage is then returned to its starting position directly adjacent to the drawing ring 10. In this return movement the predrawing carriage 2 is followed by the first main drawing carriage 3. The drawn portion of the tube 25 then passes through the predrawing carriage 2 and can be engaged by the first drawing carriage 3 (FIG. 2). The first drawing carriage begins its own drawing operation and is shifted by its linear motor to the right when the first carriage 3 has been displaced by a predetermined amount, the jaws 21*a*, 21*b* of the second carriage are actuated to engage the tube 25 and the jaws 22*a*, 22*b* are opened. The first carriage 3 is returned to the left while the second carriage continues the drawing motion to the right. The alternating displacement of the carriages 3 and 4 draws the workpiece hand-to-hand as has been described to continuously draw the workpiece at a uniform drawing speed. In this embodiment the particular drawing carriage 2 can either be operated by a linear motor complex or, for example, by a hydraulic cylinder.

FIGS. 3–7 show the drawing operations of another embodiment of the invention whereby the drawing carriages engage the tube 125 in pairs to draw the tube to the right through the die 110 from the flank 112 while the third carriage is returned to the left.

The drawing unit 101 thus differs from that of FIG. 1 in that instead of two drawing carriages, the three drawing carriages 103, 104, 123 are provided. The predrawing carriage 102 and the three main drawing carriages 103, 104 and 123 are identical in construction to the corresponding carriages of the embodiment of FIG. 1. Similar functioning elements in FIGS. 3–7 have the same enumeration as in FIG. 1 in a hundreds series.

Figure 3:
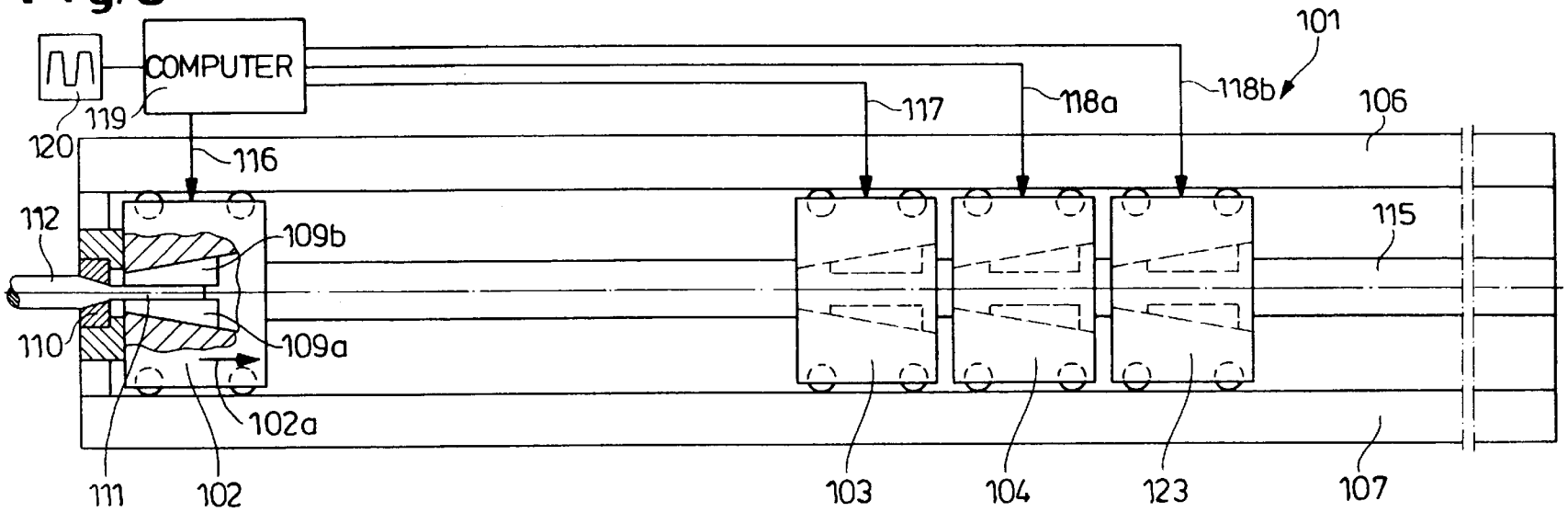
FIG. 3 is a diagram of a drawing machine having a separate predrawing carriage and three drawing carriages at the beginning of the predrawing operation.
Figure 4:
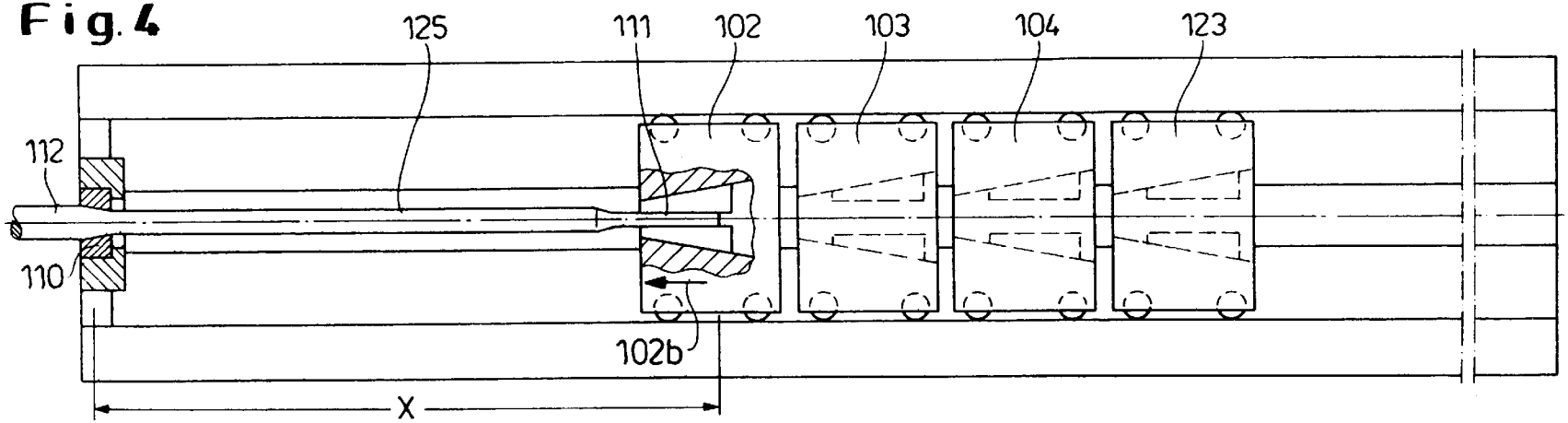
FIG. 4 is a diagram similar to that of FIG. 2 with the predrawing carriage at its full displacement.
Figure 5:
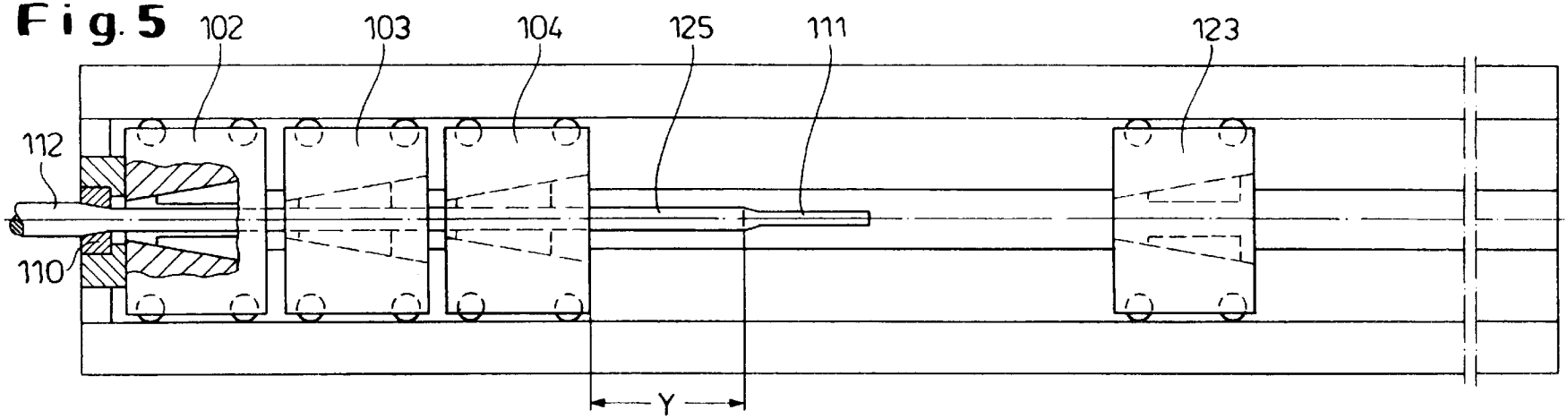
FIG. 5 is a diagram of the unit of FIG. 2 at the starting stage.
Figure 6:
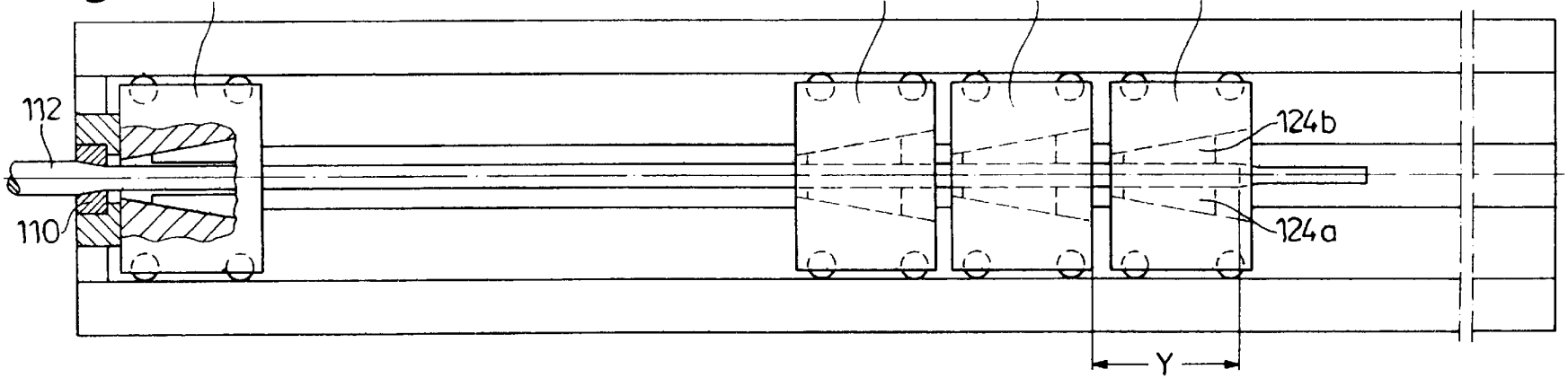
FIG. 6 is a diagram of the apparatus of FIG. 2 in a drawing stage utilizing the drawing carriage pair.
Figure 7:
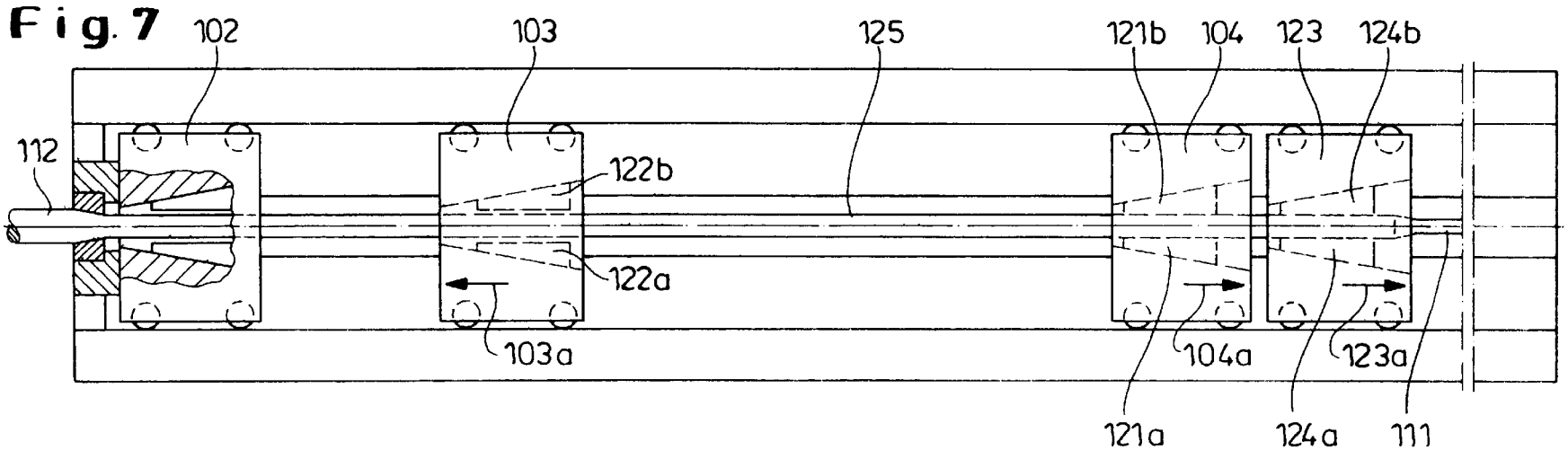
FIG. 7 is a diagram like that of FIG. 2 upon replacement of the drawing carriages engaged with the workpiece and showing the return movement of one of the carriages.

As can be seen from FIG. 3, the stem 111 which projects through the die 110 can be initially engaged in the jaws 109*a*, 109*b* of the predrawing carriage and driven in the direction of the arrow 102*a* (see the final position in FIG. 4). The linear electric motors of the carriage 102,103, 104 and 123 are controlled by the computer 119 via the lines 116, 117, 118*a*, 118*b* with the aid of the display 120.

The predrawing length x (FIG. 4) corresponds to a length which can be approximately equal to the length of the predrawing carriage 102 and the sum of the lengths of the drawing carriages plus the length of the stem 111. In this embodiment, the predrawing length x also corresponds to the distance from the die ring to the rear edge of the jaws 124*a*, 124*b* of the third carriage 123 less the length of the stem 111 when all of the carriages are next to one another and adjacent the die ring (see FIG. 5).

Then the predrawing carriage 102 is displaced in the direction of the arrow 102*b* back to its starting position. The first two drawing carriages 103, 104, i.e. the pair of drawing carriages which are closest to the predrawing carriage 102, are moved in the same direction so that the tube 125 passes through all of the carriages 102, 103, 104 and the jaws thereof (see FIG. 5).

The jaws of the first two carriages 103, 104 engage the workpiece at its large cross section 125 and can draw the workpiece to the right. This constitutes the main drawing operation. The projection portion Y at the beginning of the workpiece 125 is then passed through the jaws of the third carriage. As soon as the workpiece 125 can be engaged by the jaws of the third carriage 123, the first carriage 103 is disengaged and moved to the left while the carriages 104 and 123 continue to draw the workpiece to the right. The return of the carriage 103 in the direction of arrow 103*a* and the continued drawing action of the carriages 104 and 123 in the direction of arrows 104*a* and 123*a* has been represented in FIG. 7. Thus in the main drawing action the workpiece is engaged by a pair of carriages and the carriages participating in the drawing pair shift during the back and forth motion.

Figure 8:
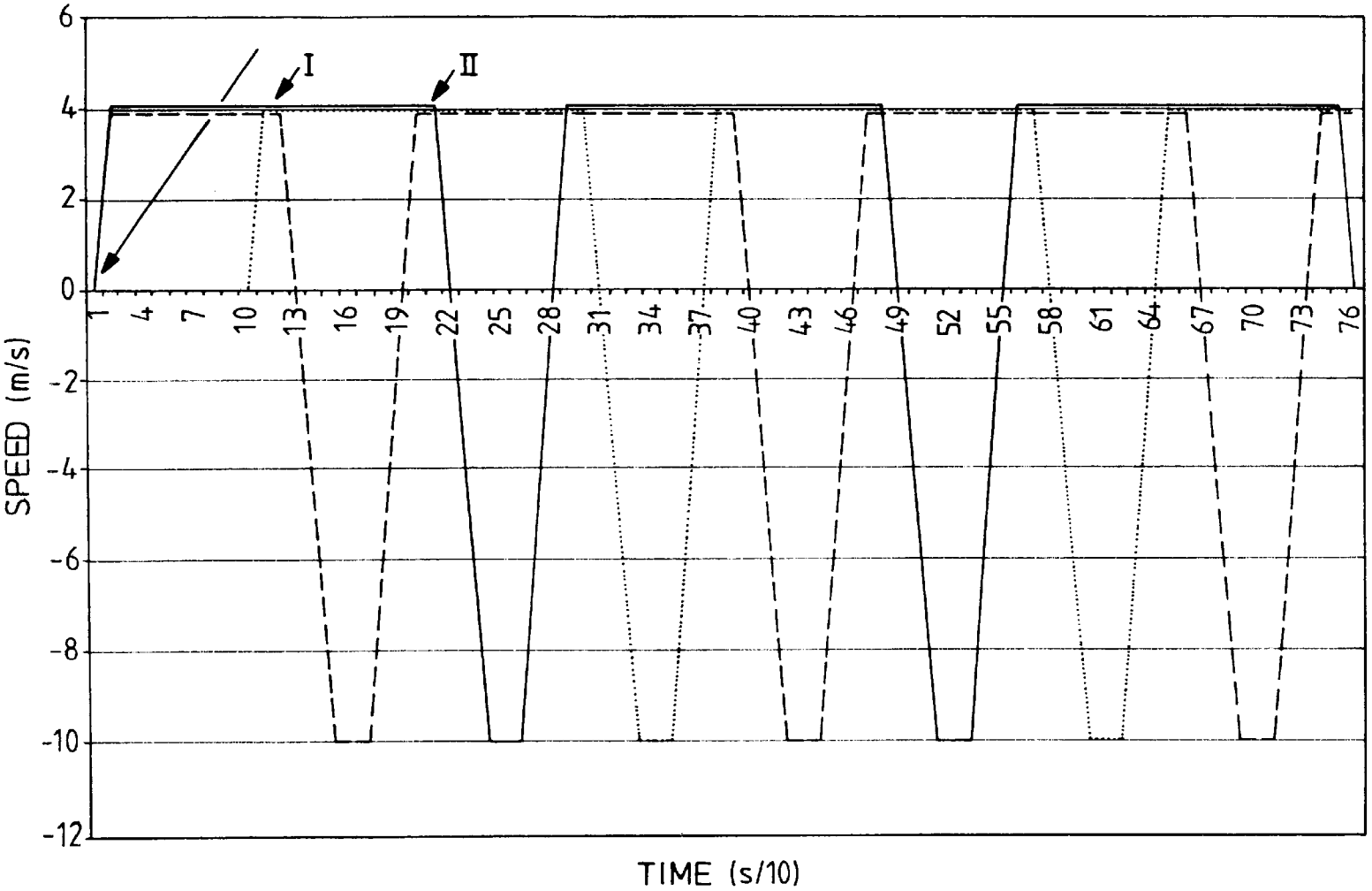
FIG. 8 is a diagram illustrating the movement pattern of the three drawing carriages for the unit of FIG. 2.

The exact movement pattern of the three carriages 103, 104 and 123 during the drawing process has been shown in FIG. 8 in which time is plotted in tenths of a second along the abscissa versus speed plotted in meters per second along the ordinate. The pattern is shown by a speed—time curve in which the dashed line represents the first carriage or carriage number 1, corresponding to carriage 103 in FIGS. 3–7. The solid line shows the pattern of the second carriage number 2 corresponding to carriage 104 in FIGS. 3–7 and the dotted line the movement pattern of the third carriage number 3 corresponding to the carriage 123 of FIGS. 3–7.

At the beginning of the drawing process, the two first carriages 103 and 104 are synchronously accelerated and displaced. This point has been shown in FIG. 5. The third carriage 103 is accelerated about 10 second afterward to the drawing speed and takes over from the first carriage 103. At the point I in the graph of FIG. 8, the third carriage 123 begins its drawing movement together with the second carriage 104 while the first carriage 103, having disengaged from the workpiece, is returned. Then the first carriage 103 is again accelerated to the drawing speed and takes over a drawing operation in conjunction with the third carriage 123 at the point II, while the second carriage 104 is disengaged from the workpiece and shifted to the left. In all drawing stages, consequently, a pair of drawing carriages participate while the third carriage is returned until the workpiece is drawn fully through the ring. The drawing speed can be 4.17 m/s while the return speed can be 10 m/s. The path length for the carriages can be 5000 mm. This drawing process which allows a carriage to be accelerated to drawing speed before it engages the workpiece and to be displaced back and forth, can be individually controlled from the computer 119.

Figure 9:
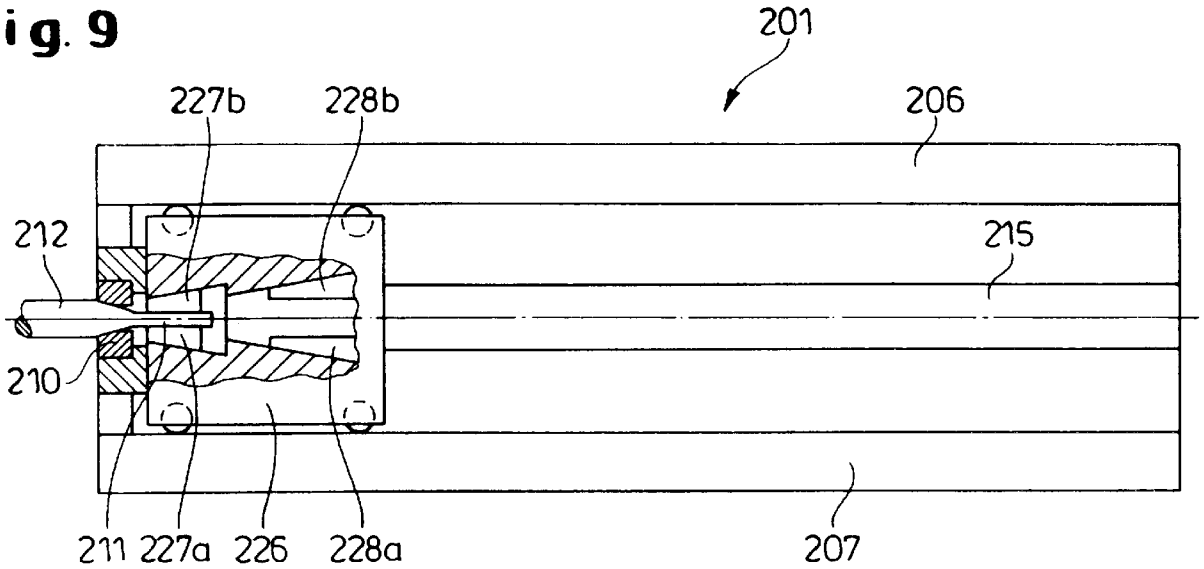
FIG. 9 is a diagram of the drawing unit having a combined predrawing and drawing carriage.

The embodiment which has been described utilizes the predrawing carriage exclusively for the initial predrawing phase and returns that carriage to a position proximal to the die. In FIG. 9, however, we show a combination predrawing and drawing carriage which can participate in the main drawing stages. The carriage is controlled by its own linear motor complex as has been described.

The basic unit 201 shown in FIG. 9 has a single carriage 226 which serves both as a predrawing carriage and also has a main drawing carriage. It has two pairs of clamping jaws 227*a*, 227*b* and 228*a* and 228*b*. The clamping jaws 227*a*, 227*b* are dimensioned to engage the larger portion of the workpiece as shaped by the die. The operation of this drawing carriage will be described subsequently in connection with FIGS. 16, 17 and 18. The drawing unit 201 can be used as or in a discontinuously operating drawing machine and after a sufficient length of the tube has been drawn through the die 210, the carriage 26 can be returned to the left to allow its jaws 228 and 228*a* to engage the stationary workpiece and effect another drawing operation. The length of the travel path will depend upon the drawing speed and draw the force which may be required. Of course the unit shown in FIG. 9 can be used in conjunction with another drawing carriage or a pair of drawing carriages to provide a hand-to-hand type of continuous operation.

Figure 10:
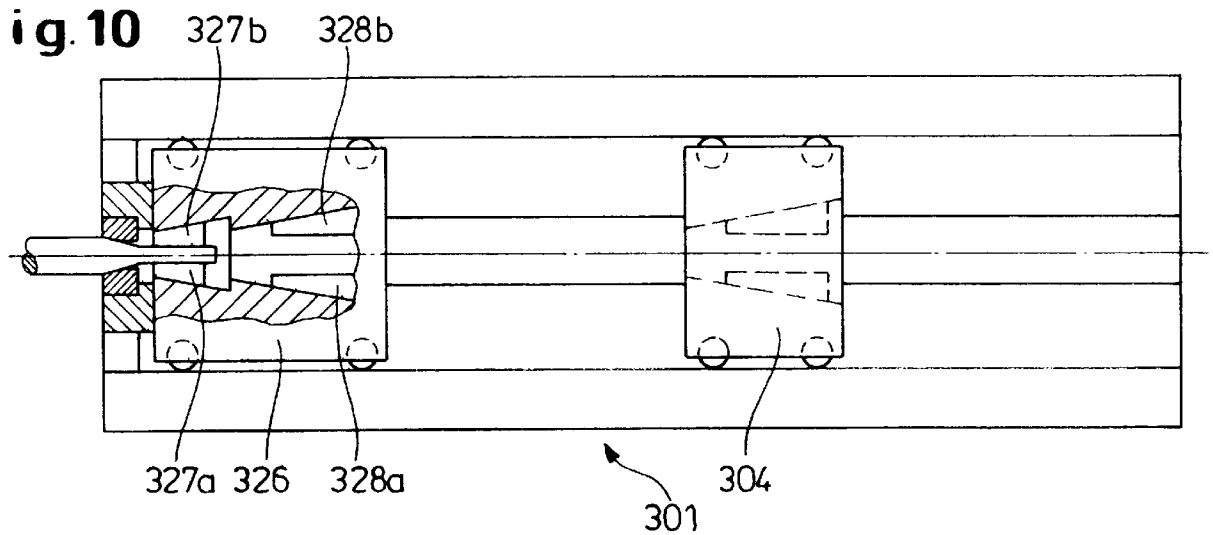
FIG. 10 is an illustration of the drawing unit of FIG. 9 with a further drawing carriage.
Figure 11:
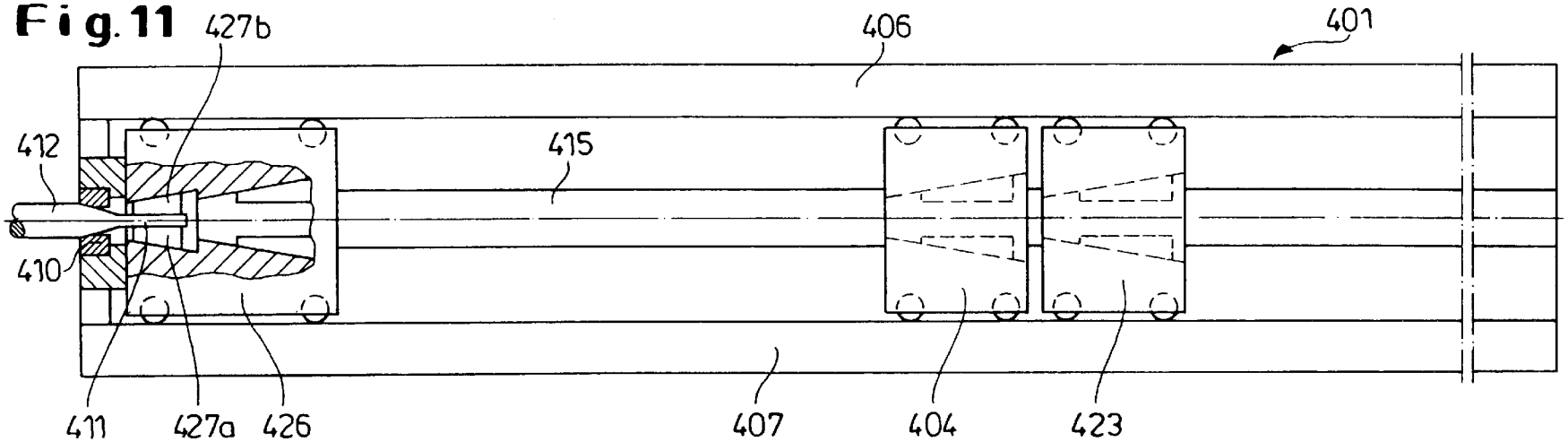
FIG. 11 is a diagram of the apparatus of FIG. 9 with two further drawing carriages at the beginning of the predrawing operation.
Figure 12:
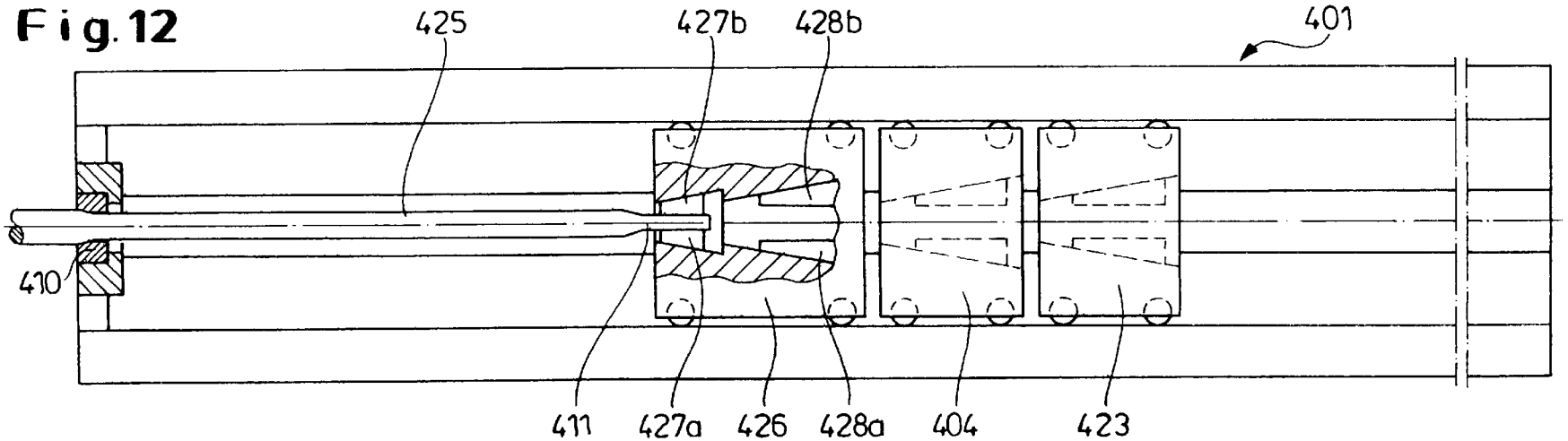
FIG. 12 is a diagram of the apparatus of FIG. 10 with a combined predrawing and drawing carriage in its extreme position.
Figure 13:
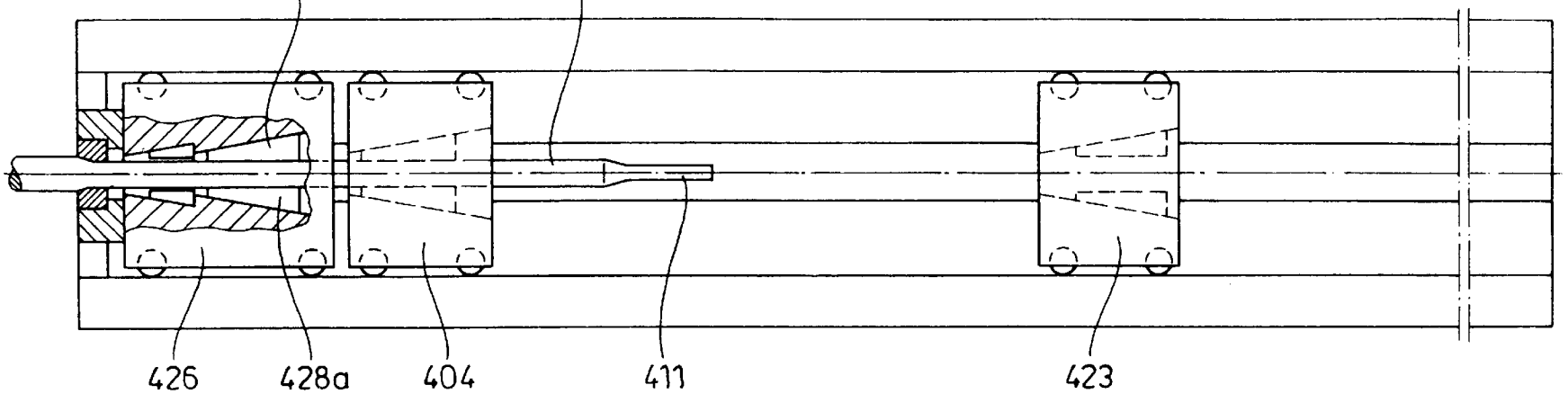
FIG. 13 is an illustration of the unit of FIG. 10 at the startup of a drawing operation.
Figure 14:
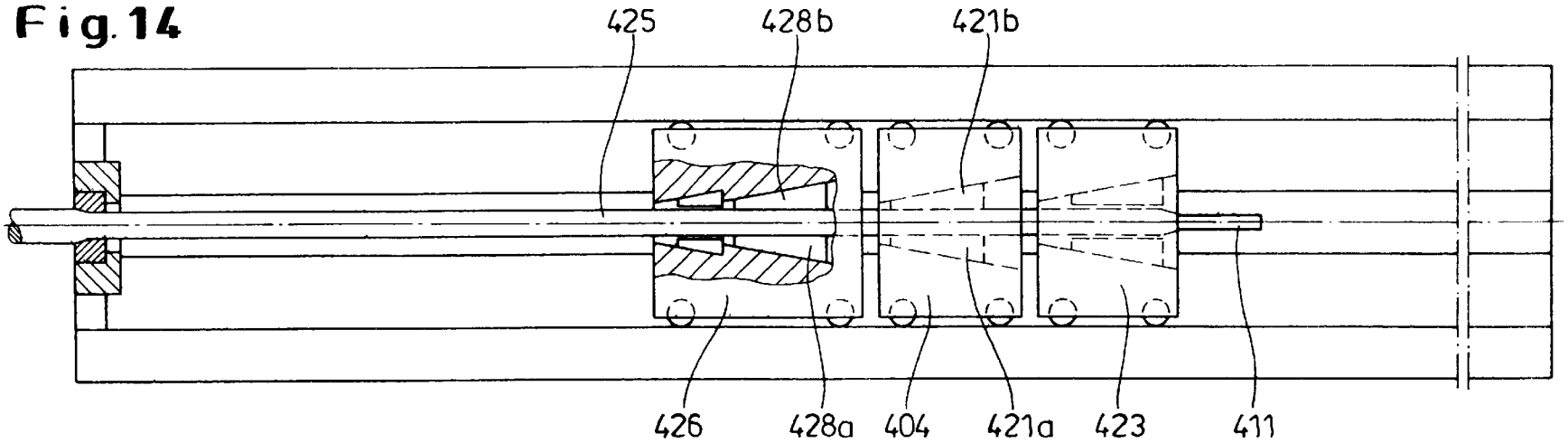
FIG. 14 is an illustration of the unit of FIG. 10 in its position with the workpiece engaged by a drawing carriage pair.
Figure 15:
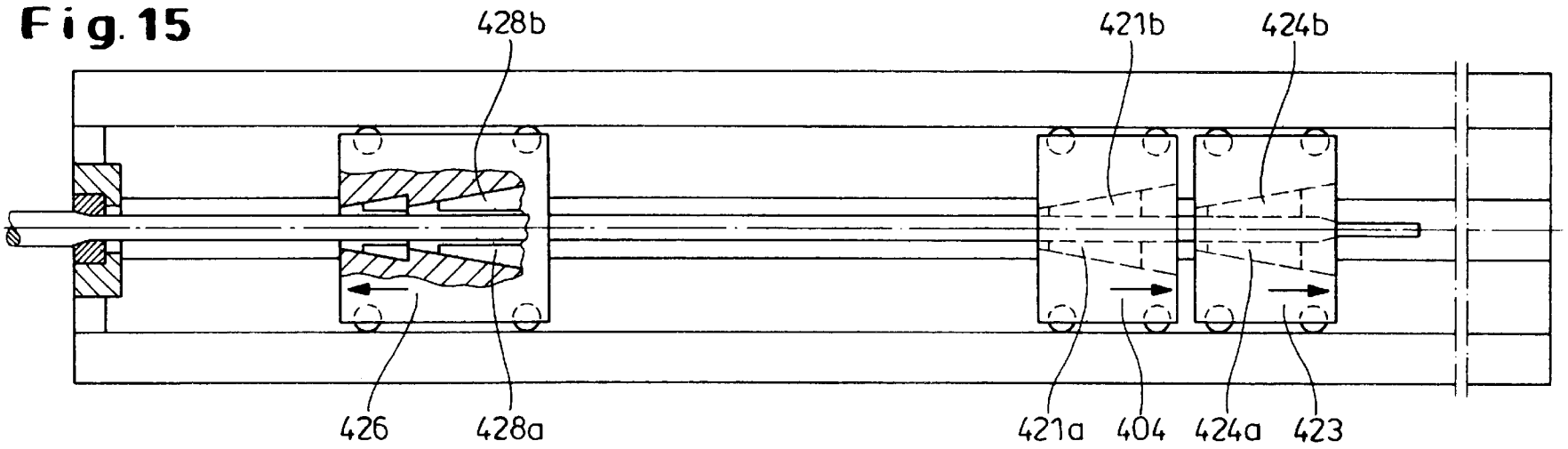
FIG. 15 is an illustration of the unit of FIG. 10 after interchange of the drawing carriages in engagement with the workpiece and return of the first or combined predrawing and drawing carriage.

By analogy with the embodiment of FIGS. 1 and 2, a unit such as that shown at 201 can be expanded by providing a second drawing carriage 304 (see FIG. 10). The drawing unit 301 thus has two drawing carriages 386, 304 in which the first is part of the combined predrawing and main drawing carriage and utilizes the clamping jaws 328*a* and 328*b* when the predrawing stage has been completed. The drawing unit of FIG. 10 can then operate as a continuous drawing unit. Initially the jaws 327*a* and 327*b* of the combi-carriage 326 engage the stem and pull the workpiece through the die to a sufficient extent to allow, upon return of the carriage 326 to the left, a sufficient portion of the workpiece to remain beyond the carriage 326 for engagement by the carriage 304. The latter can continue to pull that workpiece to the right or can be shifted to the left so that both the jaws 328*a* and 328*b* of the combi-carriage 326 and the jaws of the carriage 304 can simultaneously engage the workpiece and pull the workpiece to the right as a pair. When the carriages 326 and 304 operate in a hand-to-hand basis, they continuously draw the workpiece. Alternatively, they may operate in a discontinuous manner so as to jointly pull the workpiece whereupon both are returned to the left after each pulling stroke.

The addition of further drawing slides can provide a continuous drawing of the workpiece with paired pulling utilizing, for example, the system of FIGS. 11–15. The drawing unit 401 of FIGS. 11–15 has a combined predrawing and main drawing carriage 426 as well as two main drawing carriages 404 and 423. As soon as the predrawing process has ended (as described in connection with FIGS. 3–7), the combi-carriage 426 is shifted to the left (FIG. 13) and the carriage 404 is likewise shifted to the left while the carriage 423 remains in an intermediate position. The main drawing part of the combi-carriage 426 and the main carriage 404 then pull the works to the right until the workpiece portion 426 is engaged in the carriage 423 (see FIG. 13), whereupon, from the position shown in FIG. 14, the carriage 426 is shifted back into its starting position and the two carriages 404 and 423 continue to pull the workpiece to the right (compare FIGS. 14 and 15). The process is continued in a hand-to-hand operation as has been previously described.

Figure 16:
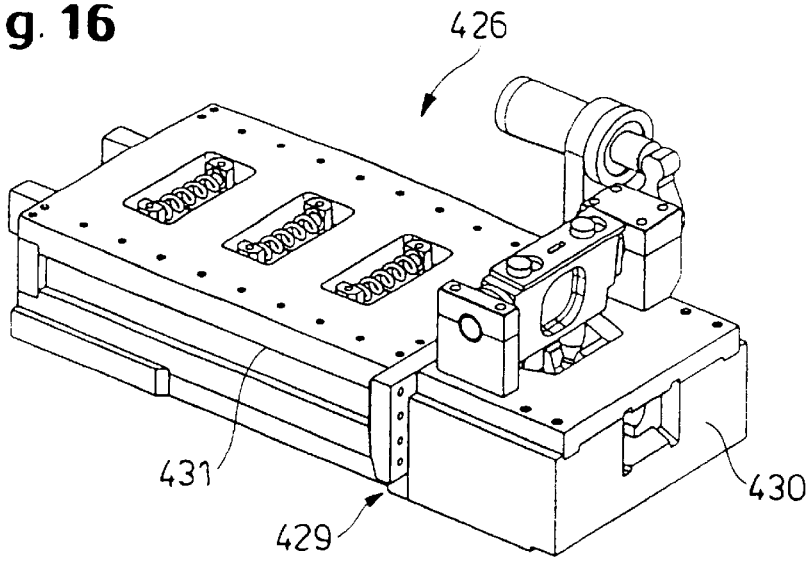
FIG. 16 is a perspective view of a combined predrawing and drawing carriage.
Figure 17:
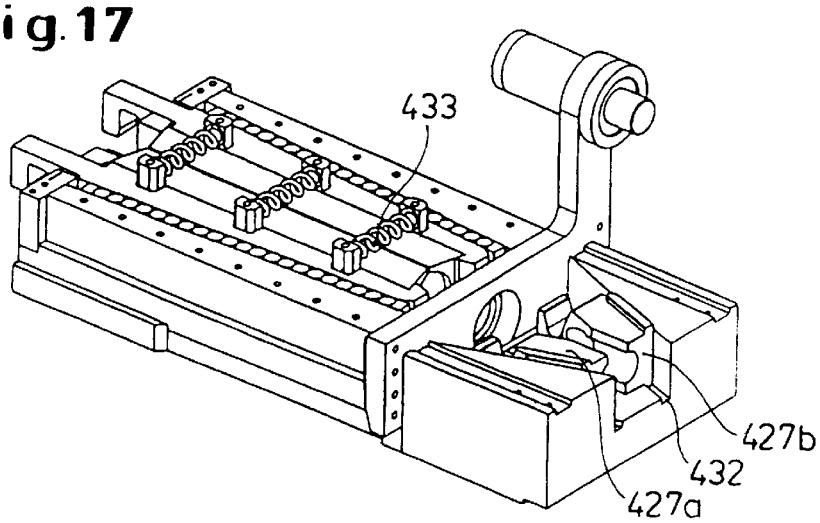
FIG. 17 is a fragmentary perspective view of a combi-carriage of FIG. 16 in horizontal section.
Figure 18:
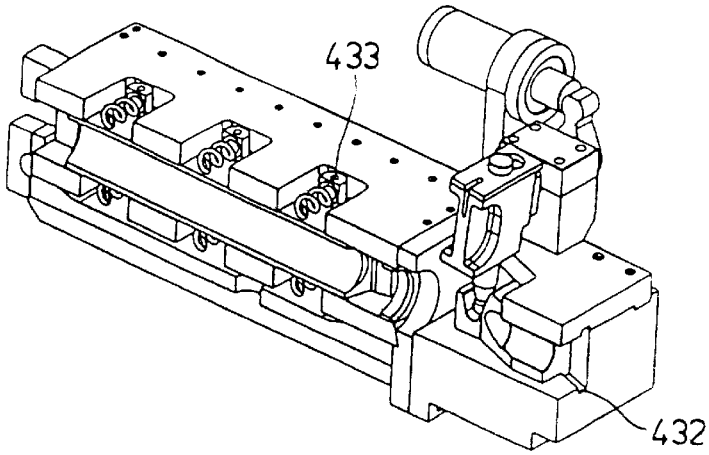
FIG. 18 is a partial perspective view of the combi-carriage of FIG. 16 in vertical section.

The carriage constructions for the combi-carriage have been illustrated, for example, in FIGS. 16–18. The combi-carriage 426 is here comprised of a basic housing 429 of first and second parts 430 and 431 with a second part following the first in the drawing direction. The first part 430 has the clamping jaws 427*a*, 427*b* for the predrawing operations and which in the clamped state, have a smaller diameter so as to engage the stem. The jaws are slidable along inclined surfaces formed by grooves 432 and thus approach one another to grip the stem when the carriage is moved away from the die. The second part 431 has the clamping jaws 428*a*, 428*b* which are urged into the clamped position by springs 433. The means for operating the clamps can include electronically-controlled effectors if desired.

Figure 19:
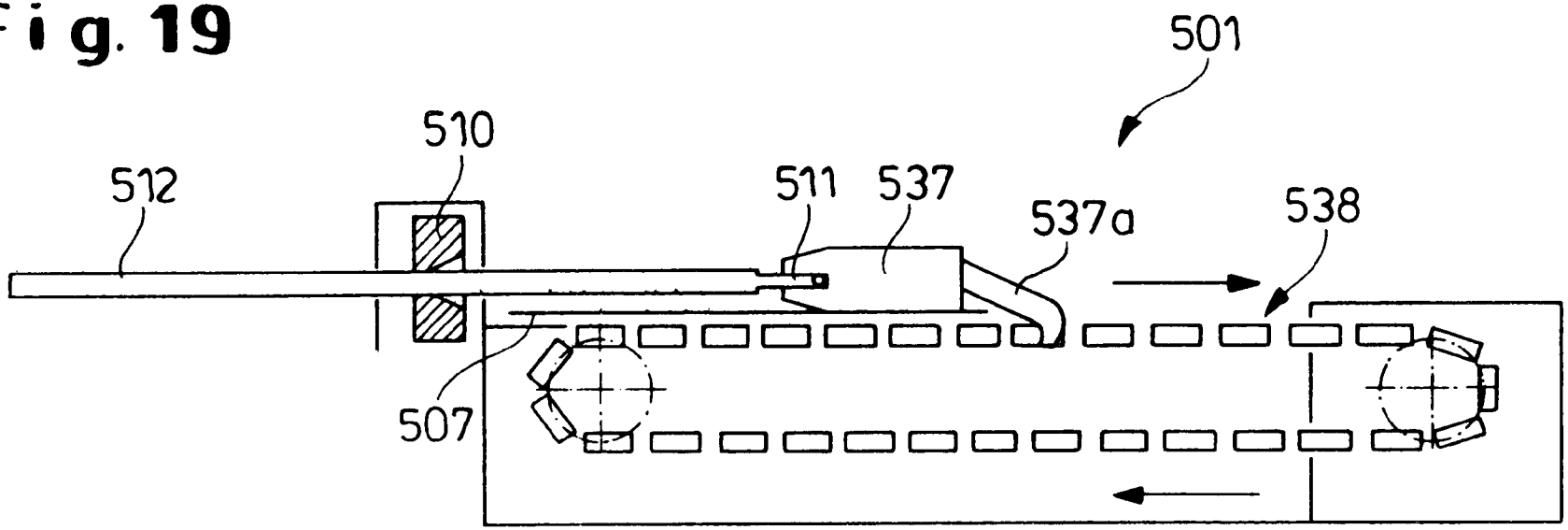
FIG. 19 is a schematic illustration of a drawing unit with a drawing carriage and chain.

FIG. 19 illustrates a system in which a drawing bench constitutes the drawing machine and has a drawing unit 501 whose carriage 537 has a pawl 537*a* which can engage in an underlying chain 538. The carriage 537 is displaceable in guides or rails 507. The carriage 537 can thus engage the stem 511 of the workpiece 512. The carriage is equipped with a linear motor complex which, after the carriage is released from the chain, can return the carriage toward the die 510. When small drawing forces are required, the chain 538 can be omitted and the carriage displaced back and forth solely by the linear motor complex. The linear motor complex can also assist the chain during the drawing operation.

Figure 20A:
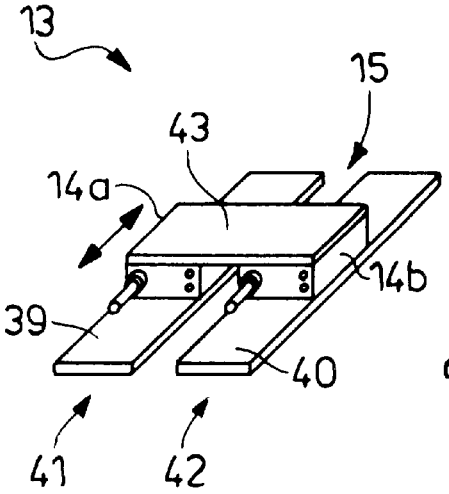
FIGS. 20A, 20B and 20C are perspective views of three embodiments of linear motor complexes each having two linear motor units with common or stationary secondary parts.
Figure 20B:
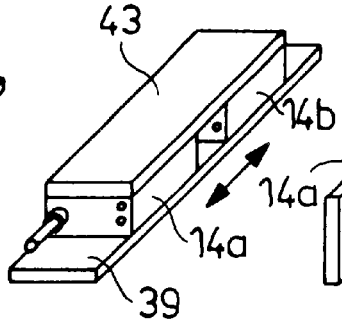
Figure 20C:
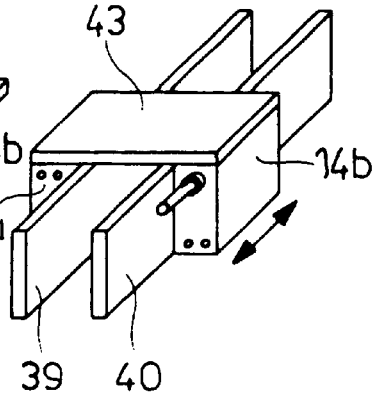

FIGS. 20*a*, 20*b* and 20*c* schematically illustrate three different embodiments of linear motor units which can be joined with others to form a respective linear motor complex.

In FIG. 20*a*, the stationary part 15 of the linear motor complex 13 is comprised of two horizontally-extending neighboring rails 39, 40 and the two primary parts 14*a*, 14*b* are displaceable along these rails on the respective carriages. The result is two linear motor units 41 and 42 joined into the linear motor complex 13. A plate 43 can connect the primary parts and serve for mounting the primary parts on the respective carriage.

In FIG. 20*b*, the two primary parts 14*a* and 14*b* connected by the plate 43 cooperate with a single rail 39. In FIG. 20*c*, the rails 39 and 40 are disposed vertically and are laterally juxtaposed with the primary part 14*a* and 14*b* connected by the plate 43.

Figure 21:
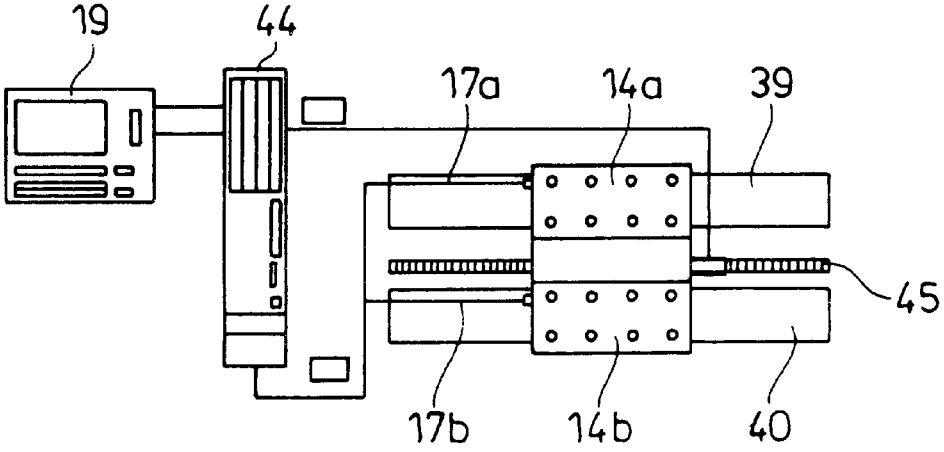
FIG. 21 is a schematic illustration of the computer and control unit for the linear motor drives.

As FIG. 21 illustrates, the computer unit 19 can be connected to a linear motor arrangement of the type shown in FIG. 20*a* and having two primary parts which are juxtaposed with and right along the two rails 39, 40. The two primary parts 14*a* and 14*b* are connected by separate signal lines 17*a* and 17*b* with the computer and through a separate controller 44 which functions as a driver for the electromagnetic components of the primary parts.

Between the rails 38 and 40, serving as the drive parts of the travel path, there is a guide track 45 which separates the carriage and can be mechanically coupled thereto.

Figure 22:
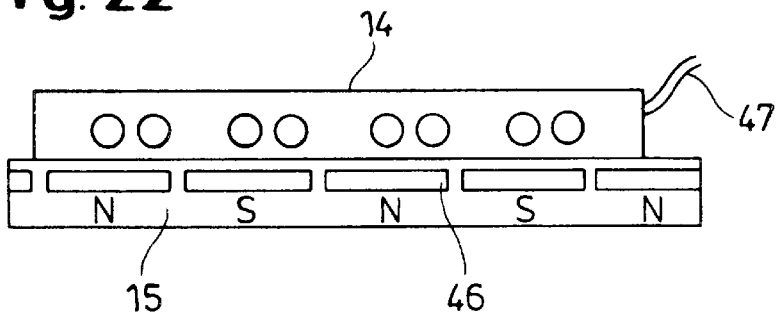
FIG. 22 is a schematic illustration of the basic structure of a linear motor.
Figure 23A:
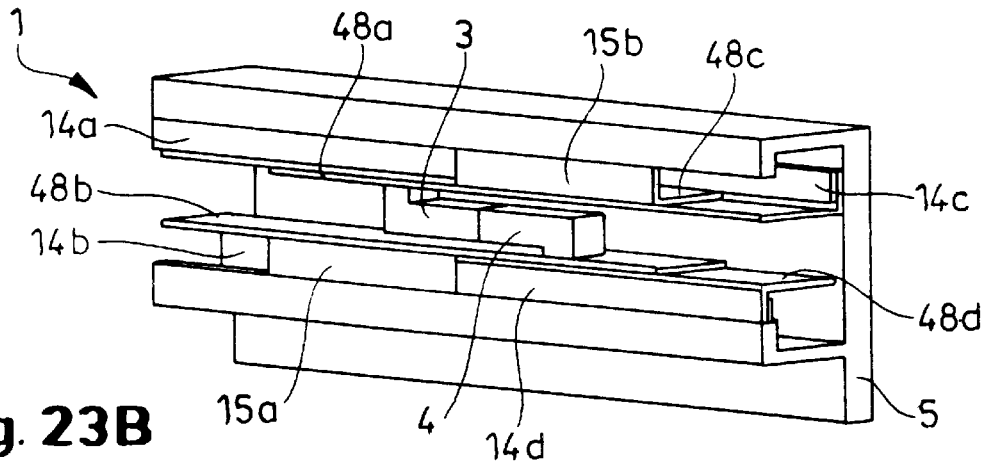
FIG. 23A and FIG. 23B are perspective views of linear motors with movable secondary parts in two different drawing states.
Figure 23B:
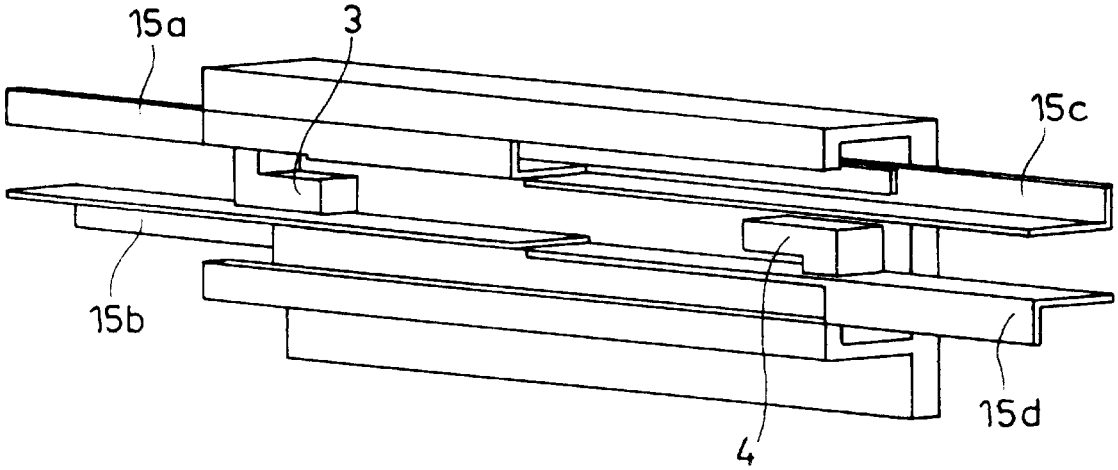

The linear motor principle with a movable primary part and a stationary secondary part, or vice versa, have been illustrated in FIGS. 22, 23 and 23*b*. FIG. 22 shows a movable secondary part 15 which can be mounted on a carriage and is comprised of permanent magnets 46 with alternating poles N and S. The stationary part 14 has three-phase electromagnet coils whose current is supplied by a cable 47. The system can be water-cooled. This arrangement has the advantage that the electric current supply and water cooling can be connected exclusively to the stationary part. Both parts 14 and 15 are elongated and juxtaposed with one another but so as to enable one to shift past the other.

An especially preferred arrangement has been shown in FIGS. 23*a* and 23*b*. Here the drawing unit 1 encompasses a rigid machine frame 5 on which the stationary primary parts 14*a*, 14*b*, 14*c* and 14*c* in the form of respective rails are mounted. Along the rails and likewise vertically oriented are the movable secondary parts 15*a*, 15*b*, 15*c* and 15*d*. For a stroke of the respective carriage 3 or 4, the individual rails slide relative to one another. The movable parts 15*a*–15*d* are mounted on the angular support elements 48*a*–48*d* whereby the carriage 3 or 4 is fastened on the horizontal portion of the support element.

FIG. 23*a* shows the drawing unit 1 with drawing carriages 3, 4 whereby the first carriage 3 is in an end position and the second carriage 4 is in a starting position of the respective stroke. The carriages are entrained by the respective support elements. During the movement of the second carriage to the right), the first carriage 3 is displaced to the left.

The linear motors allow independent control of the movement patterns of the respective carriages, operation at high speed and with high acceleration and without the wear and maintenance required for earlier systems.

We claim:

1. A drawing unit for a drawing machine capable of drawing an elongated metal workpiece and having at least one die through which the workpiece is drawn, said drawing unit comprising:

a machine frame forming an elongated path along which said workpiece is drawn;

at least one drawing carriage provided with a workpiece gripper and displaceable back and forth linearly along said path to draw said workpiece through said die; and a controlled linear motor complex assigned to said drawing carriage and acting upon the respective drawing carriage for independent displacement of the drawing carriage along said path, said linear motor complex for each said carriage comprising one or more linear motor units and the linear motor complex is assembled modularly from linear motor units with a drawing force predeterminable by selection of the number of linear motor units or the driving force of the linear motor units assembled together to form said linear motor complex, wherein said drawing carriage is formed as a combined predrawing and drawing carriage and the drawing unit has exclusively said combined carriage or said combined carriage and at least one other drawing carriage, said linear motor complex for driving said combined predrawing and drawing carriage having a greater driving force than the linear motor complex for driving said other drawing carriage.

2. The drawing unit defined in claim 1 wherein said linear motor units have primary parts connected with the respective carriage and secondary parts extending as stationary elements along said machine frame.

3. The drawing unit defined in claim 1 wherein said linear motor units have primary parts extending as stationary elements along said machine frame, and secondary parts connected with the respective carriage and movable therewith.

4. The drawing unit defined in claim 1, further comprising a computer having signal lines connected with all of said carriages for controlling the linear motor complexes thereof.

5. A drawing unit for a drawing machine capable of drawing an elongated metal workpiece and having at least one die through which the workpiece is drawn, said drawing unit comprising:

a machine frame forming an elongated path along which said workpiece is drawn;

at least one drawing carriage provided with a workpiece gripper and displaceable back and forth linearly along said path to draw said workpiece through said die; and a controlled linear motor complex assigned to said drawing carriage and acting upon the respective drawing carriage for independent displacement of the drawing carriage along said path, said linear motor complex for each said carriage comprising one or more linear motor units and the linear motor complex is assembled modularly from linear motor units with a drawing force predeterminable by selection of the number of linear motor units or the driving force of the linear motor units assembled together to form said linear motor complex, said drawing unit having a separate predrawing carriage in addition to at leapt one drawing carriage displaceable along said path, said linear motor complex for driving said predrawing carriage having a greater driving force than the linear motor complex for driving said drawing carriage.

6. The drawing unit defined in claim 5 wherein a plurality of drawing carriages are provided along said path.

7. The drawing unit defined in claim 6 wherein at least one pair of said drawing carriages are arranged to engage and pull said workpiece simultaneously.

8. A method of drawing an elongated metal workpiece, comprising the steps of:

engaging a segment of an elongated metal workpiece projecting through a drawing die with a first drawing carriage;

displacing said first drawing carriage along a linear drawing path in a machine frame with a linear electric motor complex assigned to said first drawing carriage away from said drawing die;

displacing a second drawing carriage along said drawing path toward said drawing die with a linear electric motor complex assigned to said second drawing carriage to enable said second drawing carriage to engage said workpiece; and flexibly controlling back and forth motion patterns of said carriages along said path by controlling the respective linear motor complexes to draw said workpiece.

9. The method defined in claim 8 wherein, during drawing of the workpiece away from said die, said workpiece is engaged by at least one pair of said drawing carriages.

10. The method defined in claim 8 wherein said patterns are so controlled that at least two said carriages simultaneously engage said workpiece.

11. The method defined in claim 8 wherein said patterns are controlled so that two said carriages simultaneously draw said workpiece away from said die while another said carriage, disengaged from said workpiece, is displaced toward said die.

12. The method defined in claim 8 wherein said patterns are so controlled that said workpiece is drawn continuously through said die.

13. The method defined in claim 8 wherein said patterns are so controlled that said workpiece is drawn discontinuously through said die.

* * * * *